US010208421B2

(12) United States Patent
Han et al.

(10) Patent No.: US 10,208,421 B2
(45) Date of Patent: Feb. 19, 2019

(54) LAUNDRY TREATING MACHINE

(71) Applicant: LG ELECTRONICS INC., Seoul (KR)

(72) Inventors: Sungkyong Han, Seoul (KR); Kyukwan Choi, Seoul (KR); Kyusuh Park, Seoul (KR); Minsub Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/501,314

(22) PCT Filed: Aug. 18, 2015

(86) PCT No.: PCT/KR2015/008592
§ 371 (c)(1),
(2) Date: Feb. 2, 2017

(87) PCT Pub. No.: WO2016/032159
PCT Pub. Date: Mar. 3, 2016

(65) Prior Publication Data

US 2017/0218558 A1 Aug. 3, 2017

(30) Foreign Application Priority Data

Aug. 28, 2014 (KR) ..... 10-2014-0113085

(51) Int. Cl.
*D06F 37/04* (2006.01)
*D06F 37/26* (2006.01)
(Continued)

(52) U.S. Cl.
CPC ..... *D06F 37/304* (2013.01); *D06F 37/04* (2013.01); *D06F 37/26* (2013.01); *D06F 37/30* (2013.01);
(Continued)

(58) Field of Classification Search
CPC ..... D06F 37/04; D06F 37/26; D06F 37/304; D06F 39/083; D06F 39/088; D06F 39/12
(Continued)

(56) References Cited

U.S. PATENT DOCUMENTS

2011/0271719 A1 11/2011 Fujitsuka

FOREIGN PATENT DOCUMENTS

JP H 1033877 2/1998
JP 2004-194940 7/2004
(Continued)

OTHER PUBLICATIONS

Fujizuka et al., "JP2009050684A English Machine Translation. pdf", Mar. 12, 2009—Machine translation from Espacenet.com.*
(Continued)

*Primary Examiner* — Levon J Shahinian
(74) *Attorney, Agent, or Firm* — KED & Associates, LLP

(57) ABSTRACT

A laundry treating machine is disclosed. The laundry treating machine includes a cabinet formed with a laundry introduction opening, a frame rotatably provided in the cabinet, a tub provided in the cabinet to define a space for accommodating wash water and configured to be rotated by the frame, and a drum rotatably provided in the tub to define a space for accommodating laundry and configured to rotate in a direction different from a rotating direction of the tub.

14 Claims, 6 Drawing Sheets

(51) Int. Cl.

| | |
|---|---|
| ***D06F 37/30*** | (2006.01) |
| ***D06F 39/08*** | (2006.01) |
| ***D06F 39/12*** | (2006.01) |

(52) U.S. Cl.
CPC ..... *D06F 39/083* (2013.01); *D06F 39/088* (2013.01); *D06F 39/12* (2013.01)

(58) Field of Classification Search
USPC .... 68/24, 132, 133, 139, 140, 141, 142, 232
See application file for complete search history.

(56) References Cited

FOREIGN PATENT DOCUMENTS

| | | |
|---|---|---|
| JP | 2009-050684 | 3/2009 |
| KR | 10-1997-0001646 | 1/1997 |
| KR | 10-0362857 | 11/2002 |
| KR | 10-2002-0000249 | 12/2002 |
| KR | 10-2014-0036560 | 3/2014 |
| KR | 10-2014-0045677 | 4/2014 |
| WO | WO 2010/0055674 | 5/2010 |

OTHER PUBLICATIONS

International Search Report and Written Opinion dated Dec. 1, 2015 issued in Application No. PCT/KR2015/008592 (Full English Text).
European Search Report dated Mar. 28, 2018 issued in Application No. 15836654.2.
Chinese Office Action dated Aug. 3, 2018 issued in Application No. 201580043403.7 (English Translation Attached).

* cited by examiner

[Fig. 1]
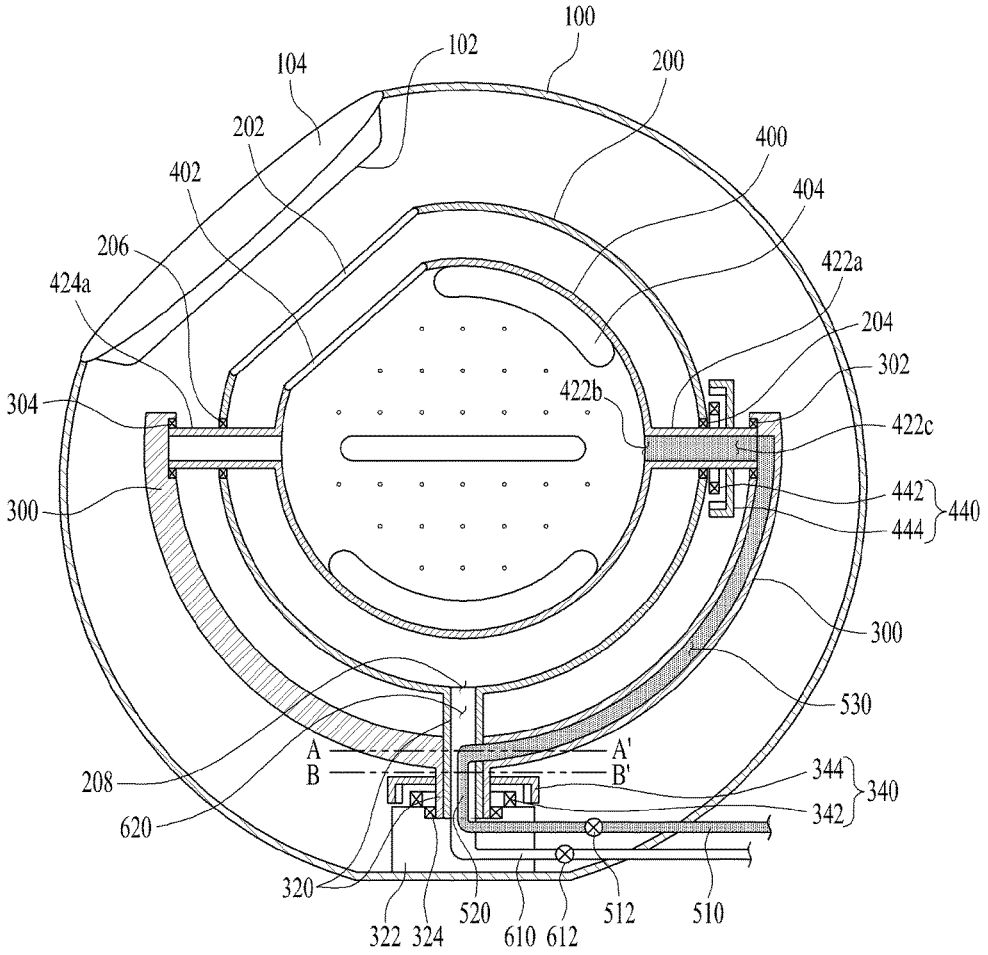

[Fig. 2]
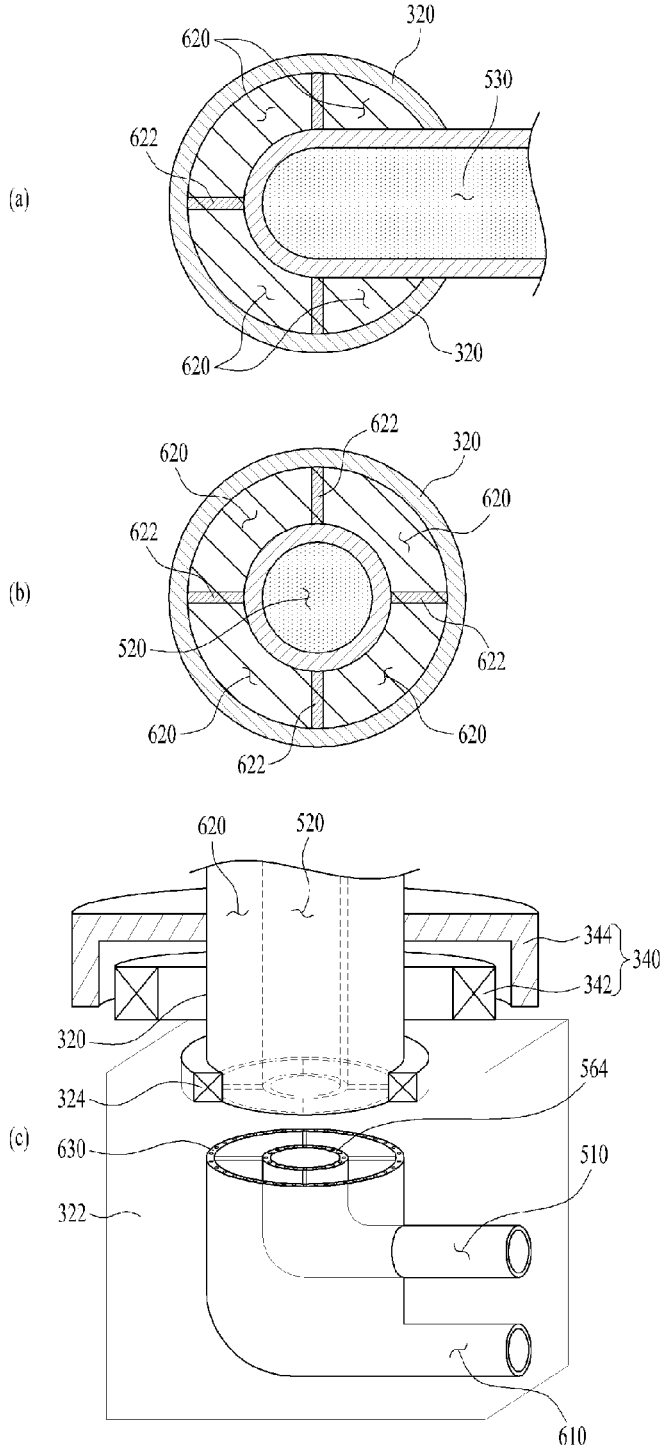

[Fig. 3]
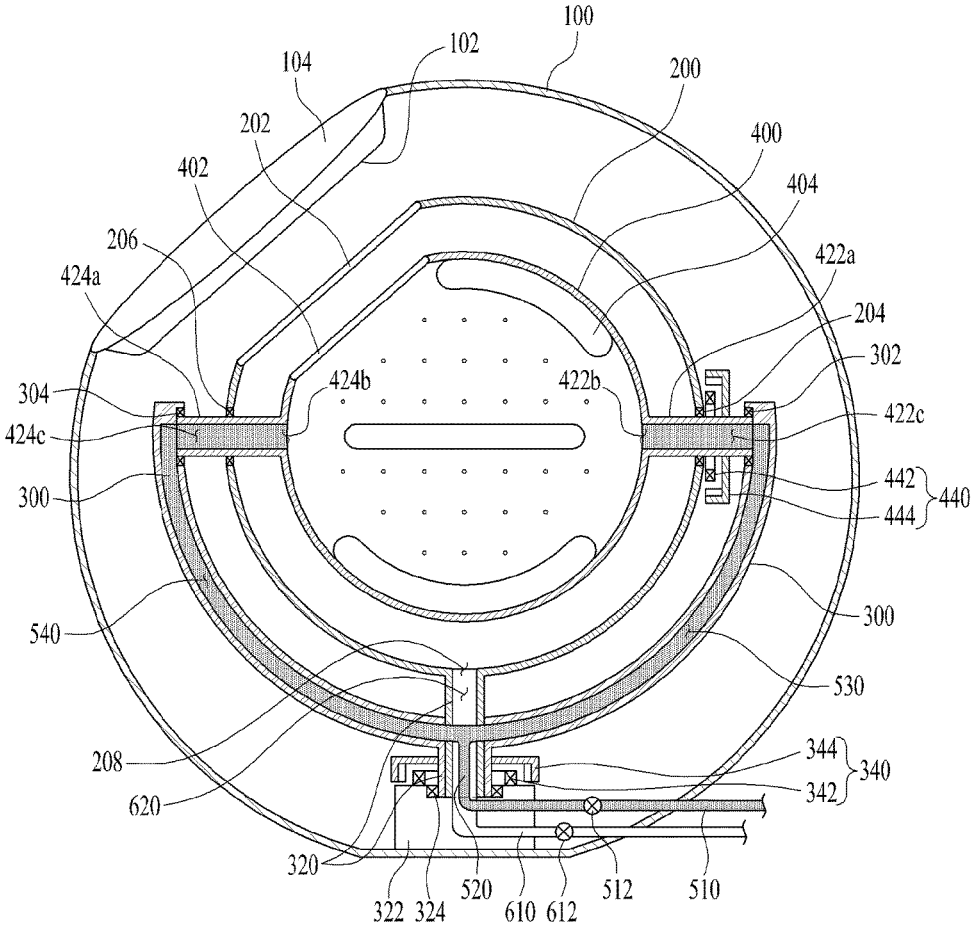

[Fig. 4]
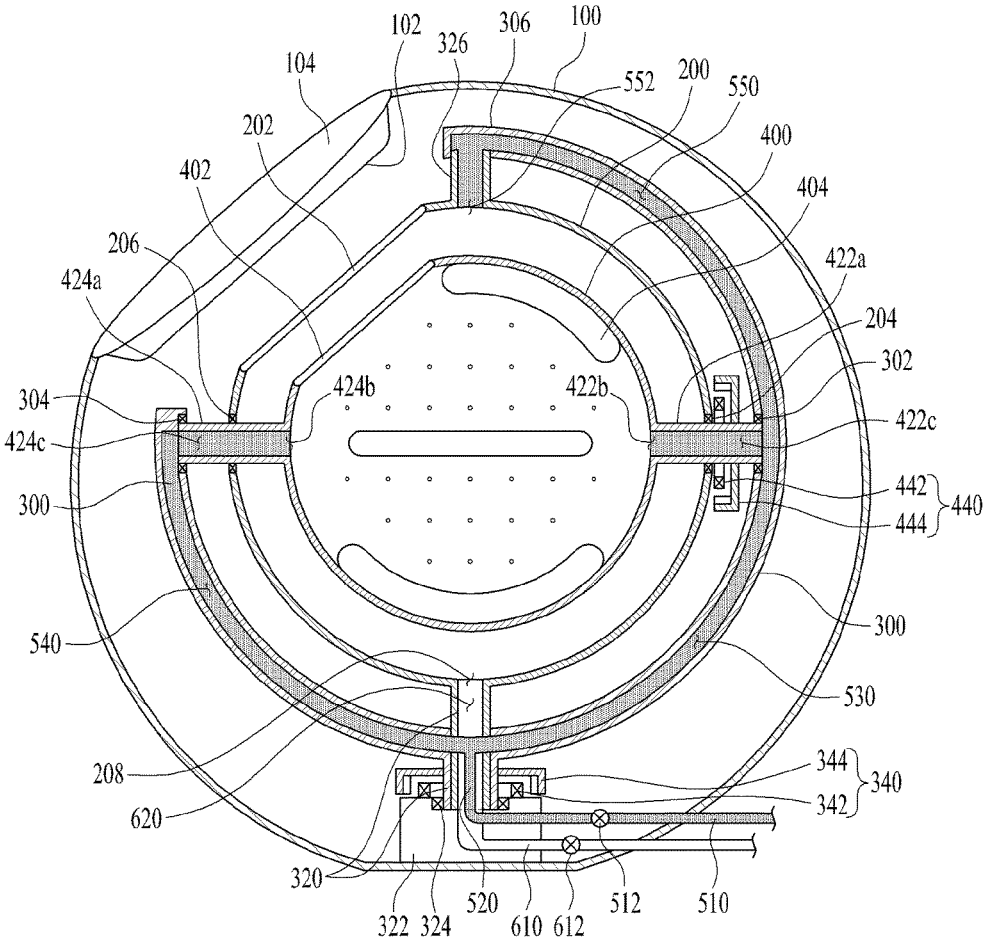

[Fig. 5]
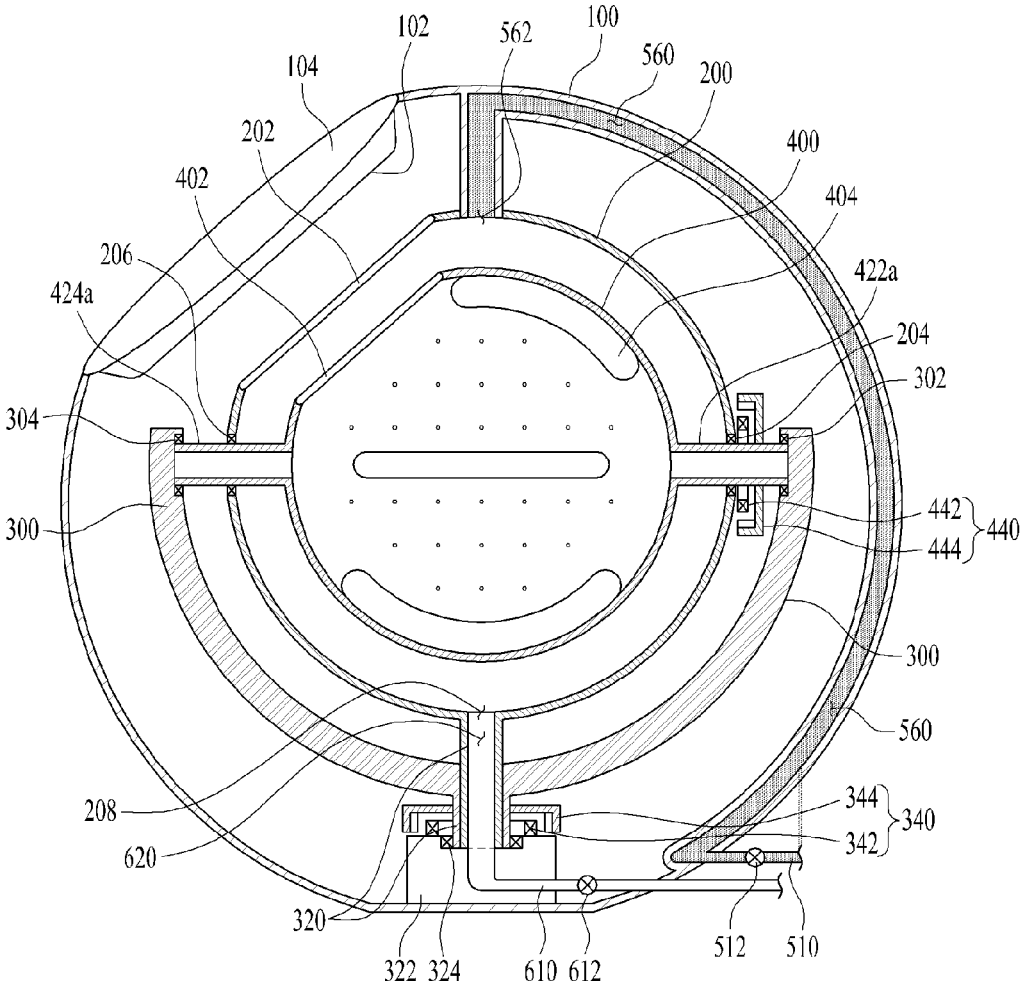

[Fig. 6]
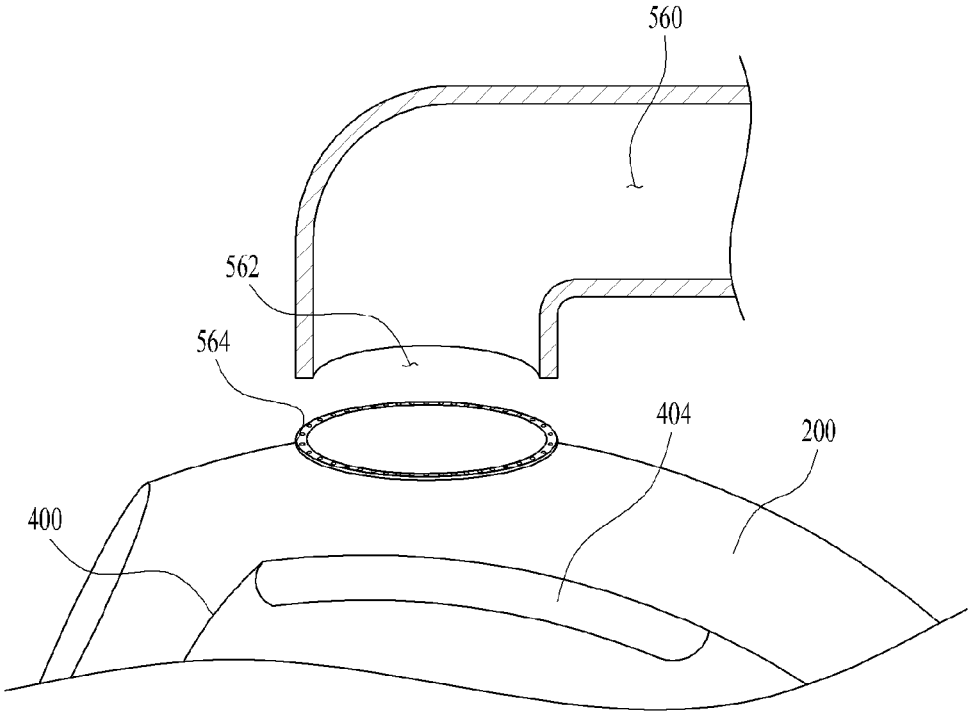

LAUNDRY TREATING MACHINE

CROSS-REFERENCE TO RELATED PATENT APPLICATIONS

This application is a U.S. National Stage Application under 35 U.S.C. § 371 of PCT Application No. PCT/KR2015/008592, filed Aug. 18, 2015, which claims priority to Korean Patent Application No. 10-2014-0113085, filed Aug. 28, 2014, whose entire disclosures are hereby incorporated by reference.

TECHNICAL FIELD

The present invention relates to a laundry treating machine.

BACKGROUND ART

A laundry treating machine refers to a machine that removes foreign materials from laundry through processes of washing, drying, refreshing and the like.

A laundry treating machine may be classified into a washing machine for washing laundry, a drying machine for drying laundry, and a refreshing machine for treating laundry using steam or the like. Recently, a laundry treating machine capable of performing washing, drying and refreshing processes together has been manufactured in order to satisfy various consumers' demands.

Although the laundry treating machine according to the present invention will be explained based on a washing machine, it will be apparent that the technical characteristics of the present invention can also be applied to a drying machine, a refreshing machine or the like, as well as a washing machine.

Typically, a washing machine is classified into a top-loading type washing machine and a front-loading type washing machine according to the way in which a drum is disposed. The top-loading type washing machine is characterized in that a laundry introduction opening is formed in the top portion thereof and a driving unit is disposed on the bottom portion thereof while the rotation axis of the driving unit extends perpendicular to the floor. The front-loading type washing machine is characterized in that a laundry introduction opening is formed in the side portion thereof and a driving unit is disposed on another side portion thereof while the rotation axis of the driving unit extends parallel to the floor.

However, both the top-loading type washing machine and the front-loading type washing machine have a limitation in the extent to which the washing effect can be improved, because a swirling flow is formed in wash water about a single rotation axis. That is, the rotation axis, about which the swirling flow rotates, is unchangeable.

Further, there is a limitation in that a washing process must be carried out over a predetermined time period in order to provide a satisfactory washing effect for a user.

DISCLOSURE OF INVENTION

Technical Problem

An object of the present invention devised to solve the problem lies on a laundry treating machine in which a tub and a drum are configured to rotate about different rotation axes, thereby forming a swirling flow of wash water that is different from that of a conventional laundry treating machine.

Another object of the present invention devised to solve the problem lies on a laundry treating machine capable of forming two or more swirling flows of wash water in different directions, thereby enhancing washing efficiency.

Solution to Problem

The object of the present invention can be achieved by providing a laundry treating machine including a cabinet formed with a laundry introduction opening, a frame rotatably provided in the cabinet, a tub provided in the cabinet to define a space for accommodating wash water and configured to be rotated by the frame, and a drum rotatably provided in the tub to define a space for accommodating laundry and configured to rotate in a direction different from a rotating direction of the tub.

The laundry treating machine may further include a frame stator fixedly mounted to a bottom portion of the cabinet and configured to generate a magnetic field, a frame rotor configured to be rotated by the magnetic field of the frame stator, and a frame support part connected with the frame rotor and the frame to transmit rotational force from the frame rotor to the frame.

The laundry treating machine may further include a first shaft connected with a portion of the drum and passing through the tub, and a second shaft connected with another portion of the drum, opposite the first shaft, and passing through the tub, wherein the first shaft and the second shaft are rotatably supported by the frame.

The laundry treating machine may further include a drum stator fixedly mounted to the tub or the frame and configured to generate a magnetic field, and a drum rotor configured to be rotated by the magnetic field of the drum stator, wherein the first shaft is connected with the drum rotor to transmit rotational force.

The frame support part may extend from the frame and may be connected with a bottom portion of the tub, and the laundry treating machine may further include a drain hole formed in the bottom portion of the tub, a second drain channel connected with the drain hole and provided inside the frame support part, and a first drain channel connected with the second drain channel to drain wash water to the outside.

The laundry treating machine may further include a base provided on the bottom portion of the cabinet and having a predetermined space therein, wherein the first drain channel is provided in the base.

The laundry treating machine may further include a second main water supply channel provided in the second drain channel, and a first main water supply channel connected with the second main water supply channel and provided in the first drain channel.

The first main water supply channel may be provided in the base.

The laundry treating machine may further include a support rib provided between the second main water supply channel and the second drain channel to support the second main water supply channel.

The laundry treating machine may further include a first shaft channel formed inside the first shaft, a first through-hole formed in the drum and connected with the first shaft channel, and a first water supply channel provided inside a wall of the frame or along an inner surface of the frame and connected with the first shaft channel, wherein the first water supply channel penetrates a side wall of the frame support part to be connected with the second main water supply channel.

The laundry treating machine may further include a second shaft channel formed inside the second shaft, a second through-hole formed in the drum and connected with the second shaft channel, and a second water supply channel provided inside a wall of the frame or along an inner surface of the frame and connected with the second shaft channel, wherein the second water supply channel penetrates a side wall of the frame support part to be connected with the second main water supply channel.

The laundry treating machine may further include an auxiliary frame support part connected with a top portion of the tub to support rotation of the tub, and an auxiliary frame for connecting the auxiliary frame support part and the frame.

The laundry treating machine may further include a third water supply channel provided inside a wall of the auxiliary frame or along an inner surface of the auxiliary frame and connected with at least one of the first water supply channel and the second water supply channel, and a third through-hole formed in the top portion of the tub and communicating with the third water supply channel.

The laundry treating machine may further include a fourth water supply channel provided along an inner surface of the cabinet and connected with an external water supply source, and a fourth through-hole formed in a top portion of the tub and communicating with the fourth water supply channel.

Advantageous Effects of Invention

A laundry treating machine according to the present invention forms a swirling flow of wash water that is different from that of a conventional laundry treating machine, by rotating a tub and a drum, provided therein, about different rotation axes.

Further, a laundry treating machine according to the present invention enhances washing efficiency by forming two or more swirling flows of wash water in different directions.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a perspective view of a laundry treating machine according to a first embodiment of the present invention;

FIG. 2*a* is a sectional view taken along line A-A' in FIG. 1;

FIG. 2*b* is a sectional view taken along line B-B' in FIG. 1;

FIG. 2*c* is a perspective view of a base and components connected thereto in a laundry treating machine according to the first embodiment of the present invention;

FIG. 3 is a perspective view of a laundry treating machine according to a second embodiment of the present invention;

FIG. 4 is a perspective view of a laundry treating machine according to a third embodiment of the present invention;

FIG. 5 is a perspective view of a laundry treating machine according to a fourth embodiment of the present invention; and FIG. 6 is a perspective view of a top portion of a tub in a laundry treating machine according to the fourth embodiment of the present invention.

BEST MODE FOR CARRYING OUT THE INVENTION

Reference will now be made in detail to the preferred embodiments of the present invention, examples of which are illustrated in the accompanying drawings.

As shown in FIG. 1, a laundry treating machine according to the present invention may include a cabinet 100 for forming the outer appearance thereof. The cabinet 100 may have a laundry introduction opening 102, through which laundry is introduced into or taken out of the cabinet 100, and a door 104 for opening and closing the laundry introduction opening 102.

The laundry treating machine may further include a frame 300, which is rotatably provided in the cabinet 100, and a tub 200, which is provided in the cabinet 100 to define a space for accommodating wash water and is configured to be rotated by the frame 300.

The frame 300 may have any constitution as long as the frame 300 can rotate in the cabinet 100. The frame 300 may be configured separately from the tub 200, or may be configured integrally with the tub 200.

Preferably, the frame 300 may be provided between the cabinet 100 and the tub 200, and the tub 200 may be connected with the frame 300 and configured to rotate with the frame 300.

The constitution for rotating the frame 300 in the cabinet 100 will now be described.

The laundry treating machine according to the present invention may include a frame driving unit 340 to rotate the frame 300.

The frame driving unit 340 may include a frame stator 342 mounted to the cabinet 100 and a frame rotor 344 configured to be rotated by a magnetic field of the frame stator 342.

The frame stator 342 may be fixedly mounted to the bottom portion of the cabinet 100.

The frame stator 342 may include a coil (not shown) configured to receive external power and generate a magnetic field, and a core (not shown) around which the coil is wound.

The laundry treating machine according to the present invention may include a frame support part 320 to transmit rotational force of the frame rotor 344. The frame support part 320 may be connected with the frame rotor 344 and the frame 300.

Accordingly, when the frame rotor 344 is rotated by the frame stator 342, the frame 300 connected with the frame support part 320 may also rotate therewith.

A frame bearing 324 may be provided at an end portion or a side portion of the frame support part 320, in order to secure smooth rotation of the frame support part 320 and prevent rotational unbalance thereof.

The laundry treating machine according to the present invention may include a drum 400 which is rotatably provided in the tub 200 and configured to define a space for accommodating laundry.

The drum 400 and the tub 200, similar to those of a typical laundry treating machine, may be formed in a cylindrical shape having an open surface. However, the drum 400 and the tub 200 may preferably be formed in a spherical shape so as to rotate in different directions.

The frame 300, which is connected with the tub 200 to rotate therewith, may also be formed in a spherical shape to surround the entire area of the tub 200. However, in order to prevent the unnecessary waste of materials, the frame 300 may be formed in a shape surrounding part of the tub 200.

If the drum 400 has a spherical shape, the volume of the tub 200 may be minimized, and if the tub 200 has a spherical shape, the frame 300 may be formed in a shape surrounding the tub 200 and the volume of the cabinet 100 may be minimized, thereby reducing the space occupied by the laundry treating machine.

The drum 400 may be configured to rotate in a direction that is different from the direction of rotation of the frame 300. Further, the drum 400 may be configured to rotate in a direction that is different from the direction of rotation of the tub 200.

In other words, the drum 400 may rotate about a rotation axis that is different from that of the frame 300 or the tub 200. To achieve this, a driving unit (described later) for the drum 400 may be provided separately from the driving unit for the frame 300.

A first swirling flow generated by rotation of the tub 200 and a second swirling flow generated by rotation of the drum 400 may be formed in the wash water accommodated in the tub 200. Accordingly, the first swirling flow and the second swirling flow may have rotation axes of different directions.

That is, the laundry treating machine according to the present invention can form swirling flows of wash water, which rotate about several different axes in the drum. Therefore, the washing effect due to the swirling flows in two different directions in the laundry treating machine of the present invention is improved beyond that of a conventional laundry treating machine, in which the tub 200 and the drum 400 rotate in the same direction.

The constitution for rotating the drum 400 will now be explained.

The laundry treating machine of the present invention may include a first shaft 422*a* connected with a portion of the drum 400 and passing through the tub 200, and a second shaft 424*a* connected with another portion of the drum 400, opposite the first shaft 422*a*, and passing through the tub 200.

The first shaft 422*a* and the second shaft 424*a* may be rotatably connected with the frame 300.

Therefore, when the drum 400 rotates, the first shaft 422*a* and the second shaft 424*a* rotate while being supported by the frame 300.

In order to secure smooth rotation of the first shaft 422*a*, a first tub bearing 204 may be provided at the portion of the tub 200 through which the first shaft 422*a* passes. The first tub bearing 204 may include a sealing member (not shown) to prevent the wash water in the tub 200 from leaking.

A second tub bearing 206 may be provided at the portion of the tub 200 through which the second shaft 424*a* passes in order to secure smooth rotation of the second shaft 424*a*. The second tub bearing 206 may include a sealing member (not shown) to prevent the wash water in the tub 200 from leaking.

The frame 300 may include a first frame bearing 302 and a second frame bearing 304, which are respectively provided at portions supporting the first shaft 422*a* and the second shaft 424*a*.

Therefore, the frame 300 supports the first shaft 422*a* and the second shaft 424*a* so as to allow the first and second shafts 422*a* and 424*a* to smoothly rotate.

Hereinafter, a means for rotating the drum 400 will be explained.

The laundry treating machine of the present invention may include a drum driving unit 440 to rotate the drum 400.

The drum driving unit 440 may include a drum stator 442, which is fixedly mounted to the tub 200 or the frame 300, and a drum rotor 444 configured to be rotated by the drum stator 442.

The drum stator 442 may be disposed on the outer peripheral surface of the tub 200 or the outer peripheral surface of the frame 300.

The drum stator 442 may include a coil configured to receive external power and generate a magnetic field, and a core around which the coil is wound. The drum rotor 444 is rotated by the magnetic field generated by the drum stator 442.

The drum rotor 444 is connected with any one of the first shaft 422*a* and the second shaft 424*a*. Accordingly, when the drum rotor 444 rotates, the drum 400 connected with the first shaft 422*a* and the second shaft 424*a* can also rotate.

The constitution for draining wash water of the laundry treating machine of the present invention will now be explained.

As described above, the frame support part 320 may be connected with the frame 300 and the frame rotor 344.

In addition, the frame support part 320 may extend toward the tub 200 so as to be connected with the tub 200. Preferably, the frame support part 320 may be connected with the bottom portion of the tub 200.

That is, the frame support part 320 may be connected with the frame rotor 344, the frame 300, and the bottom portion of the tub 200.

The frame support part 320 may have a second drain channel 620 formed therein.

The second drain channel 620 may be configured as a separate component from the frame support part 320, however, it is preferable to integrally form the second drain channel 620 inside the frame support part 320.

Therefore, the second drain channel 620 can rotate together with the frame support part 320.

The tub 200 may have a drain hole 208 formed in the bottom portion thereof, which functions as a passage for draining the wash water from the tub 200.

The drain hole 208 may communicate with an end portion of the second drain channel 620, thereby draining the wash water from the tub 200.

A valve (not shown) may be provided in the drain hole 208 or the second drain channel 620, so as to store the wash water in the tub 200 during a washing process.

A base 322 having a predetermined space therein may be provided on the bottom portion of the cabinet 100.

The laundry treating machine of the present invention may include a first drain channel 610, which is connected with the second drain channel 620 and functions as a passage for draining the wash water from the tub 200 to the outside.

The reason for dividing the drain passage into the first drain channel 610 and the second drain channel 620 is as follows.

The second drain channel 620 is configured to rotate with the frame support part 320, but the first drain channel 610 is configured to be fixedly provided in the space of the base 322 so as not to rotate.

This is because, while a tub of a typical laundry treating machine is non-rotatably fixed in the machine, the tub 200 of the laundry treating machine of the present invention is configured to rotate, and thus it is impossible to form the drain passage for draining the wash water from the tub 200 using a single drain channel.

Accordingly, the drain passage of the laundry treating machine of the present invention is divided into the second drain channel 620, which is connected with the tub 200 to drain the wash water, and the first drain channel 610, which is connected with the second drain channel 620 and fixed to the base 322.

A drain bearing 630 may be provided between the second drain channel 620 and the first drain channel 610.

The drain bearing 630 functions to allow the second drain channel 620 to smoothly rotate with respect to the first drain channel 610 fixedly mounted to the base 322. The drain bearing 630 also functions to prevent separation of the second drain channel 620 during rotation.

The drain bearing 630 may include a sealing member (not shown), which prevents the wash water from leaking between the second drain channel 620 and the first drain channel 610 during a draining process.

A drain valve 612 may be provided in the first drain channel 610 so as to store the wash water in the tub 200 during a washing process.

The frame stator 342 may be mounted on the top surface of the base 322.

The frame bearing 324, which supports the frame support part 320 so that the frame support part 320 can smoothly rotate, may be disposed in the base 322.

Hereinafter, various embodiments for water supply of the laundry treating machine according to the present invention will be described.

Referring to FIGS. 1 and 2, the laundry treating machine according to the present invention may include a second main water supply channel 520, which is provided in the second drain channel 620, and a first main water supply channel 510, which is connected with the second main water supply channel 520 and is provided in the first drain channel 610.

The first main water supply channel 510 is also connected with an external water supply source, and functions to supply wash water into the laundry treating machine.

Although not illustrated in the drawings, the second main water supply channel 520 may be arranged along the entire region of the second drain channel 620 and connected with the drain hole 208. Therefore, wash water can be supplied to the bottom of the tub 200 through the drain hole 208. In this case, the water supply process and the drain process may be controlled by electronically controlling the valve (not shown) provided in the drain hole 208.

Referring again to FIG. 1, the second main water supply channel 520 may be arranged along a partial region of the second drain channel 620, i.e., from the end portion of the frame support part 320 to the frame 300.

This is because the second main water supply channel 520 is connected with a first water supply channel 530 (described later) or a second water supply channel 540 (described later), which is provided inside of the frame 300 or along the inner surface of the frame 300.

As described above, the first drain channel 610 and the second drain channel 620, which are connected with each other, function to drain the wash water from the tub 200.

Because the first main water supply channel 510 is disposed in the first drain channel 610 and the second main water supply channel 520 is disposed in the second drain channel 620, it is required to prevent the supplied wash water and the drained wash water from mixing.

Therefore, the first main water supply channel 510 and the second main water supply channel 520 are configured such that the joined portions thereof (i.e., end portions of the respective channels, which are connected with each other) have the same diameter and the same center.

A support rib may be provided between the first drain channel 610 and the first main water supply channel 510, and a support rib may also be provided between the second drain channel 620 and the second main water supply channel 520.

Therefore, the first main water supply channel 510 may be supported to be located at the center of the first drain channel 610, and the second main water supply channel 520 may be supported to be located at the center of the second drain channel 620.

Only a part of the first main water supply channel 510, which is connected with the second main water supply channel 520, may be located in the first drain channel 610.

Therefore, the first main water supply channel 510 may penetrate the side wall of the first drain channel 610 so as to be connected with an external water supply source.

In this case, a sealing member (not shown) may be provided at the portion of the first drain channel 610 that the first main water supply channel 510 penetrates, in order to prevent leakage of the wash water flowing through the first drain channel 610.

Further, the first main water supply channel 510 may further include a water supply valve 512.

The laundry treating machine of the present invention may include a first shaft channel 422*c* formed inside the first shaft 422*a*, a first through-hole 422*b* formed in the drum 400 and connected with the first shaft channel 422*c*, and a first water supply channel 530 provided inside of the frame 300 or along the inner surface of the frame 300 and connected with the first shaft channel 422*c*.

The first water supply channel 530 may penetrate a side wall of the frame support part 320 to be connected with the second main water supply channel 520.

The frame 300 may have a predetermined space formed inside the wall thereof, in which the first water supply channel 530 is provided, or the first water supply channel 530 may be provided along the inner surface of the frame 300.

The first shaft channel 422*c* may be integrally formed inside the first shaft 422*a*.

A bearing (not shown) with a sealing member (not shown) may be provided between the first shaft channel 422*c* and the first water supply channel 530. The bearing may function to allow the first shaft channel 422*c*, which is connected with the first water supply channel 530 formed in the frame 300, to smoothly rotate.

The wash water supplied through the second main water supply channel 520 may pass through the first water supply channel 530, and may be supplied into the drum 400 through the first shaft channel 422*c*.

Accordingly, the wash water sprayed from the lateral surface of the drum 400 strikes the laundry due to falling force or water pressure, thereby obtaining an excellent washing effect.

A laundry treating machine according to a second embodiment of the present invention will now be described with reference to FIG. 3.

The laundry treating machine according to the second embodiment may include a second shaft channel 424*c* formed inside the second shaft 424*a*, a second through-hole 424*b* formed in the drum 400 and connected with the second shaft channel 424*c*, and a second water supply channel 540 provided inside of the frame 300 or along the inner surface of the frame 300 and connected with the second shaft channel 424*c*.

The second water supply channel 540 may penetrate the side wall of the frame support part 320 so as to be connected with the second main water supply channel 520.

The frame 300 may have a predetermined space formed inside the wall thereof, in which the second water supply channel 540 is provided, or the second water supply channel 540 may be provided along the inner surface of the frame 300.

The second shaft channel 424*c* may be integrally formed inside the second shaft 424*a*.

A bearing (not shown) with a sealing member (not shown) may be provided between the second shaft channel 424*c* and the second water supply channel 540. The bearing may function to allow the second shaft channel 424*c*, which is connected with the second water supply channel 540 formed in the frame 300, to smoothly rotate.

The wash water supplied through the second main water supply channel 520 may pass through the second water supply channel 540, and may be supplied into the drum 400 through the second shaft channel 424*c*.

Accordingly, the wash water sprayed from the lateral surface of the drum 400 strikes the laundry due to falling force or water pressure, thereby obtaining an excellent washing effect.

In order to further enhance the washing effect, valves (not shown) may be provided in the first shaft channel 422*c* and the second shaft channel 424*c* so as to adjust the amount or spraying sequence of wash water supplied into the drum 400.

A laundry treating machine according to a third embodiment of the present invention will now be described with reference to FIG. 4.

The laundry treating machine according to the third embodiment may include an auxiliary frame support part 326, which is connected with a portion of the tub 200 that is opposite to the frame support part 320 in order to support rotation of the tub 200, and an auxiliary frame 306 for connecting the auxiliary frame support part 326 with a portion of the frame 300.

If the frame 300 and the tub 200 are supported only by the frame support part 320, excessive torsional stress may be applied to the frame support part 320 if the tub 200 rotates when filled with wash water. The auxiliary frame support part 326 and the auxiliary frame 306 may effectively disperse the torsional stress together with the frame support part 320.

The laundry treating machine may further include a third water supply channel 550, which is provided inside of the auxiliary frame 306 or along the inner surface of the auxiliary frame 306 and is connected with at least one of the first water supply channel 530 and the second water supply channel 540, and a third through-hole 552, which is formed in the top portion of the tub 200 and communicates with the third water supply channel 550.

Since the wash water supplied through the third through-hole 552 falls and strikes the laundry, the washing effect may be further enhanced. Further, in the beginning of the washing process, since the wash water is sprayed from the top of the tub 200, the laundry may get wet rapidly, and the washing time may be reduced.

A valve (not shown) may be provided in the third water supply channel 550.

The valve of the third water supply channel 550 may adjust the amount or spraying sequence of wash water falling into the tub 200 together with the valves provided in the first water supply channel 530 and the second water supply channel 540.

A laundry treating machine according to a fourth embodiment of the present invention will now be described with reference to FIG. 5.

The laundry treating machine according to the fourth embodiment may include a fourth water supply channel 560, which is provided along the inner surface of the cabinet 100 and is connected with an external water supply source, and a fourth through-hole 562, which is formed in the top portion of the tub 200 and communicates with the fourth water supply channel 560.

The fourth water supply channel 560 may be provided in addition to the first water supply channel 530 and the second water supply channel 540. Alternatively, the fourth water supply channel 560 may be provided alone, without the first water supply channel 530 and the second water supply channel 540, in order to supply wash water into the tub 200.

Accordingly, since the water supply channel does not need to be provided in the frame support part 320, the structure may be simplified. Further, since the first drain channel 610 and the second drain channel 620 do not need to be provided in the frame 300, the structure of the frame 300 may be simplified, and the intensity of the frame 300 may be increased.

As shown in FIG. 6, a water supply bearing 564 may be provided between the fourth through-hole 562 and the fourth water supply channel 560.

Since the fourth through-hole 562 is formed in the top of the tub 200, the fourth through-hole 562 rotates with the tub 200. The water supply bearing 564 disposed between the fourth through-hole 562 and the fourth water supply channel 560 may enable the tub 200 to smoothly rotate, thereby minimizing torsional stress applied to the frame support part 320.

In order to disperse and minimize the torsional stress applied to the frame support part 320, connecting members (not shown) for connecting the frame 300 and the tub 200 may be provided in regions between the frame 300 and the tub 200, in which the first shaft 422*a* or the second shaft 424*a* are disposed.

MODE FOR THE INVENTION

Various embodiments have been described in the best mode for carrying out the invention.

INDUSTRIAL APPLICABILITY

The present invention provides a laundry treating machine in which a tub and a drum are configured to rotate about different rotation axes, thereby forming a swirling flow of wash water that is different from that of a conventional laundry treating machine.

Further, the laundry treating machine according to the present invention enhances washing efficiency by forming two or more swirling flows of wash water in different directions.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundry treating machine comprising:

a cabinet formed with a laundry introduction opening;

a frame rotatably provided in the cabinet;

a tub provided in the cabinet to define a space for accommodating wash water and configured to be rotated by the frame; and a drum rotatably provided in the tub to define a space for accommodating laundry and configured to rotate in a direction different from a rotating direction of the tub, wherein the frame includes a frame support part to transmit a rotational force, and shafts to be connected with the drum through the tub, wherein the rotational force by the frame support part is conveyed to the tub and the drum through the frame, wherein the shafts comprise:

a first shaft connected with a first portion of the drum and passing through the tub; and a second shaft connected with a second portion of the drum, opposite the first shaft, and passing through the tub, wherein the first shaft and the second shaft are rotatably supported by the frame to rotate the drum.

2. The laundry treating machine according to claim 1, further comprising:

a frame stator fixedly mounted to a bottom portion of the cabinet and configured to generate a magnetic field; and a frame rotor configured to be rotated by the magnetic field of the frame stator, and wherein the frame support part connected with the frame rotor and the frame to transmit rotational force from the frame rotor to the frame.

3. The laundry treating machine according to claim 2, further comprising:

a drum stator fixedly mounted to the tub or the frame and configured to generate a magnetic field; and a drum rotor configured to be rotated by the magnetic field of the drum stator, wherein the first shaft is connected with the drum rotor to transmit rotational force.

4. The laundry treating machine according to claim 3, wherein the frame support part extends from the frame and is connected with a bottom portion of the tub, the laundry treating machine further comprising:

a drain hole formed in the bottom portion of the tub;

a second drain channel connected with the drain hole and provided inside the frame support part; and a first drain channel connected with the second drain channel to drain wash water to the outside.

5. The laundry treating machine according to claim 4, further comprising:

a base provided on the bottom portion of the cabinet and having a predetermined space therein, wherein the first drain channel is provided in the base.

6. The laundry treating machine according to claim 4, further comprising:

a second main water supply channel provided in the second drain channel; and a first main water supply channel connected with the second main water supply channel and provided in the first drain channel.

7. The laundry treating machine according to claim 6, wherein the first main water supply channel is provided in a base of the laundry treating machine.

8. The laundry treating machine according to claim 6, further comprising:

a support rib provided between the second main water supply channel and the second drain channel to support the second main water supply channel.

9. The laundry treating machine according to claim 6, further comprising:

a first shaft channel formed inside the first shaft;

a first through-hole formed in the drum and connected with the first shaft channel; and a first water supply channel provided inside of the frame or along an inner surface of the frame and connected with the first shaft channel.

10. The laundry treating machine according to claim 9, wherein the first water supply channel or the second water supply channel penetrates a side wall of the frame support part to be connected with the second main water supply channel.

11. The laundry treating machine according to claim 10, further comprising:

an auxiliary frame support part connected with a top portion of the tub to support rotation of the tub; and an auxiliary frame for connecting the auxiliary frame support part and the frame.

12. The laundry treating machine according to claim 11, further comprising:

a third water supply channel provided inside of the auxiliary frame or along an inner surface of the auxiliary frame and connected with at least one of the first water supply channel and the second water supply channel; and a third through-hole formed in the top portion of the tub and communicating with the third water supply channel.

13. The laundry treating machine according to claim 6, further comprising:

a second shaft channel formed inside the second shaft;

a second through-hole formed in the drum and connected with the second shaft channel; and a second water supply channel provided inside of the frame or along an inner surface of the frame and connected with the second shaft channel.

14. The laundry treating machine according to claim 4, further comprising:

a fourth water supply channel provided along an inner surface of the cabinet and connected with an external water supply source; and a fourth through-hole formed in a top portion of the tub and communicating with the fourth water supply channel.

* * * * *